US011448151B1

(12) United States Patent
Campbell et al.

(10) Patent No.: US 11,448,151 B1
(45) Date of Patent: Sep. 20, 2022

(54) METHODS AND SYSTEMS FOR IMPROVING FUEL INJECTION

(71) Applicant: Ford Global Technologies, LLC, Dearborn, MI (US)

(72) Inventors: Ian D. Campbell, Casco, MI (US); Joseph Lyle Thomas, Farmington Hills, MI (US); Rani Kiwan, Canton, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/203,606

(22) Filed: Mar. 16, 2021

(51) Int. Cl.
*F02D 41/20* (2006.01)
*F02D 41/30* (2006.01)

(52) U.S. Cl.
CPC ..... *F02D 41/20* (2013.01); *F02D 41/30* (2013.01); *F02D 2041/2027* (2013.01); *F02D 2041/2041* (2013.01); *F02D 2041/2048* (2013.01); *F02D 2041/2055* (2013.01); *F02D 2041/2058* (2013.01); *F02D 2041/2062* (2013.01); *F02D 2200/101* (2013.01)

(58) Field of Classification Search
CPC ..... F02D 2041/2027; F02D 2041/2041; F02D 2041/2048; F02D 2041/2055; F02D 2041/2058; F02D 2041/2062
See application file for complete search history.

(56) References Cited

U.S. PATENT DOCUMENTS 8,935,114 B2 1/2015 Beer et al.
9,435,281 B2 9/2016 Parrish et al.
9,494,100 B2 11/2016 Rösel
9,932,947 B2 4/2018 Nehl et al.
2014/0124601 A1* 5/2014 Imai ..... F02D 41/20 239/585.1
2016/0208725 A1* 7/2016 Fukuda ..... F02D 41/20
2017/0122245 A1* 5/2017 Takeuchi ..... F01N 3/2006
2019/0010889 A1 1/2019 Ferrara et al.
2019/0242322 A1* 8/2019 Chia ..... F02M 63/0052

FOREIGN PATENT DOCUMENTS

DE 102016203191 A1 8/2017

OTHER PUBLICATIONS

Pursifull, R. et al., "Methods and Systems for Compensating for Fuel Injector Closing Time," U.S. Appl. No. 17/204,254, filed Mar. 17, 2021, 43 pages.
Pursifull, R. et al., "Methods and Systems for Improving Furl Injection Repeatability," U.S. Appl. No. 17/205,384, filed Mar. 18, 2021, 44 pages.
Kiwan, R. et al., "Methods and Systems for Controlling Fuel Injector Holding Current," U.S. Appl. No. 17/209,014, filed Mar. 22, 2021, 40 pages.

* cited by examiner

*Primary Examiner* — Erick R Solis
(74) *Attorney, Agent, or Firm* — Vincent Mastrogiacomo; McCoy Russell LLP

(57) ABSTRACT

Systems and methods for improving accuracy of an amount of fuel injected to an engine are disclosed. In one example, a maximum fuel injector holding current value is adjusted from a higher value to a lower value within a predetermined amount of time of an end of fuel injection. By adjusting the maximum fuel injector holding current value, it may be possible to reduce variation in an amount of fuel that is injected via the fuel injector.

17 Claims, 5 Drawing Sheets

METHODS AND SYSTEMS FOR IMPROVING FUEL INJECTION

FIELD

The present description relates to a system and methods for improving accuracy of an amount of fuel that is injected to an engine. The methods may be particularly useful for direct fuel injectors.

BACKGROUND AND SUMMARY

Even though a group of fuel injectors may be of a same type and produced in a similar way, each of the fuel injectors in the group of fuel injectors may inject slightly more or less fuel than other injectors for a commanded fuel pulse width. The variation of injected fuel amount may be due to manufacturing tolerances and material variations. One way to improve accuracy of an amount of fuel that a fuel injector injects may be to measure a pressure drop that occurs in a fuel rail to determine an amount of fuel that has been injected by the fuel injector. The fuel injector's transfer function may be adapted so that the actual amount of fuel that is injected nearly matches the amount of fuel that is requested to be injected. While such a procedure may improve an amount of fuel that is injected at the present operating conditions of the fuel injector, the fuel injector's operating conditions may change a short time later so that adaptation of the fuel injector's transfer is performed again to reduce errors in the amount of fuel injected. Therefore, the fuel injection system may chase fuel injection errors that result from changes in fuel injector operating conditions without converging to a solution that is desired under a wide range of fuel injector operating conditions.

The inventors herein have recognized the above-mentioned disadvantages and have developed a method for operating a fuel injector, comprising: adjusting a maximum holding current value from a first value to a second value via a controller during a first fuel injection period of the fuel injector.

By reducing a maximum holding current during a fuel injection period, it may be possible to reduce fuel delivery variation. In particular, the inventors have discovered that variation in an amount of fuel injected may be reduced by reducing a range of holding current that may be applied to a fuel injector. A fuel injector's closing time may be affected by an amount of electrical current that is flowing through the fuel injector at a time when the fuel injector is commanded off. If a larger amount of electrical current is flowing through the fuel injector when the fuel injector is commanded off, it may take a longer amount of time to close the fuel injector and cease fuel flow. Conversely, if a smaller amount of electrical current is flowing through the fuel injector when the fuel injector is commanded off, it may take less time to close the fuel injector. As such, a fuel injection variation may be reduced by reducing a range of holding current that may be applied to a fuel injector.

The present description may provide several advantages. In particular, the approach may reduce variation of an amount of fuel injected via a fuel injector. Additionally, the approach may reduce the influence of nominal fuel injector operating conditions (e.g., temperature, battery voltage, etc.) on fuel injection variation. Further, the approach may be implemented with existing system hardware.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
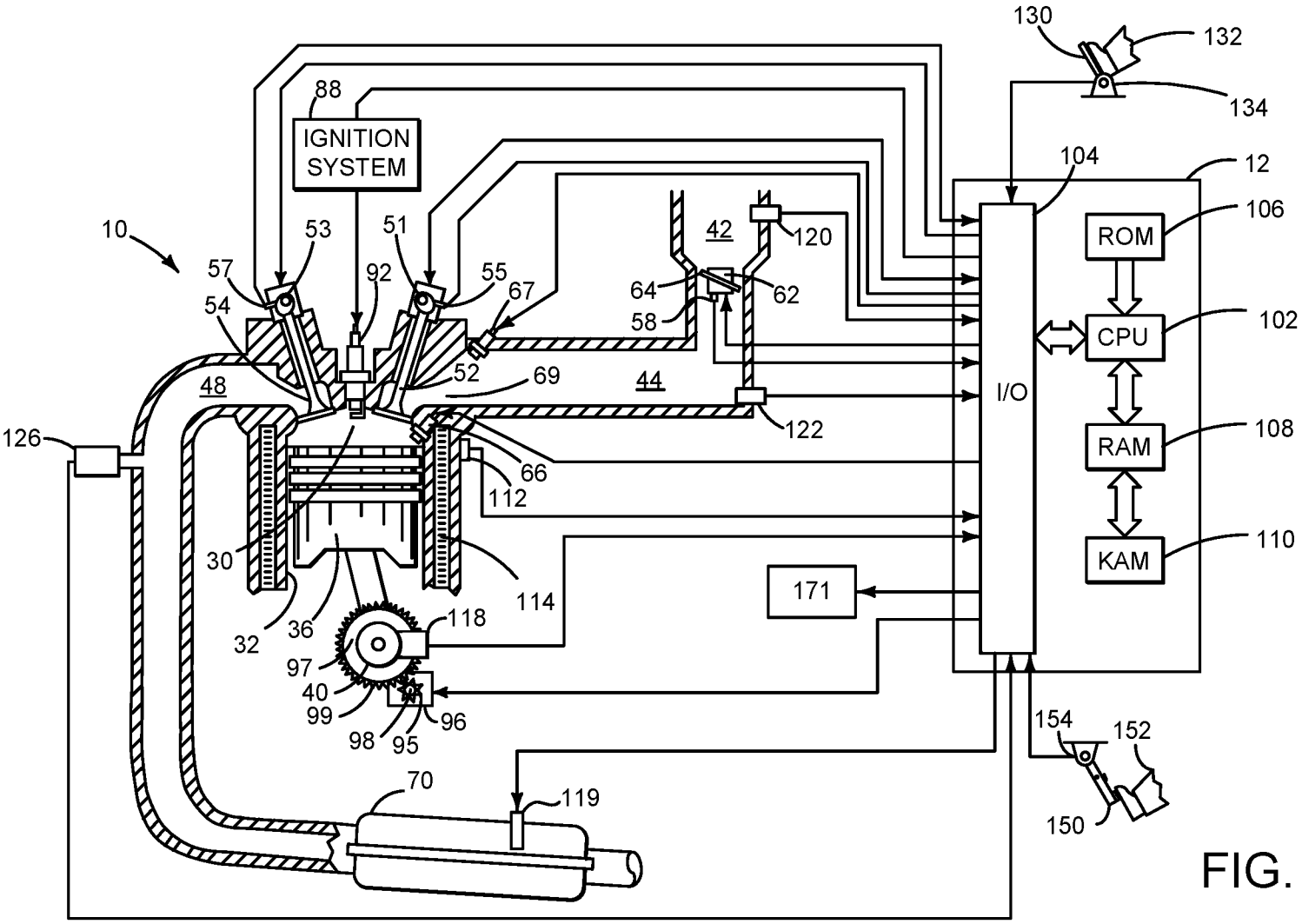
FIG. 1 is a schematic diagram of an engine.
Figure 2:
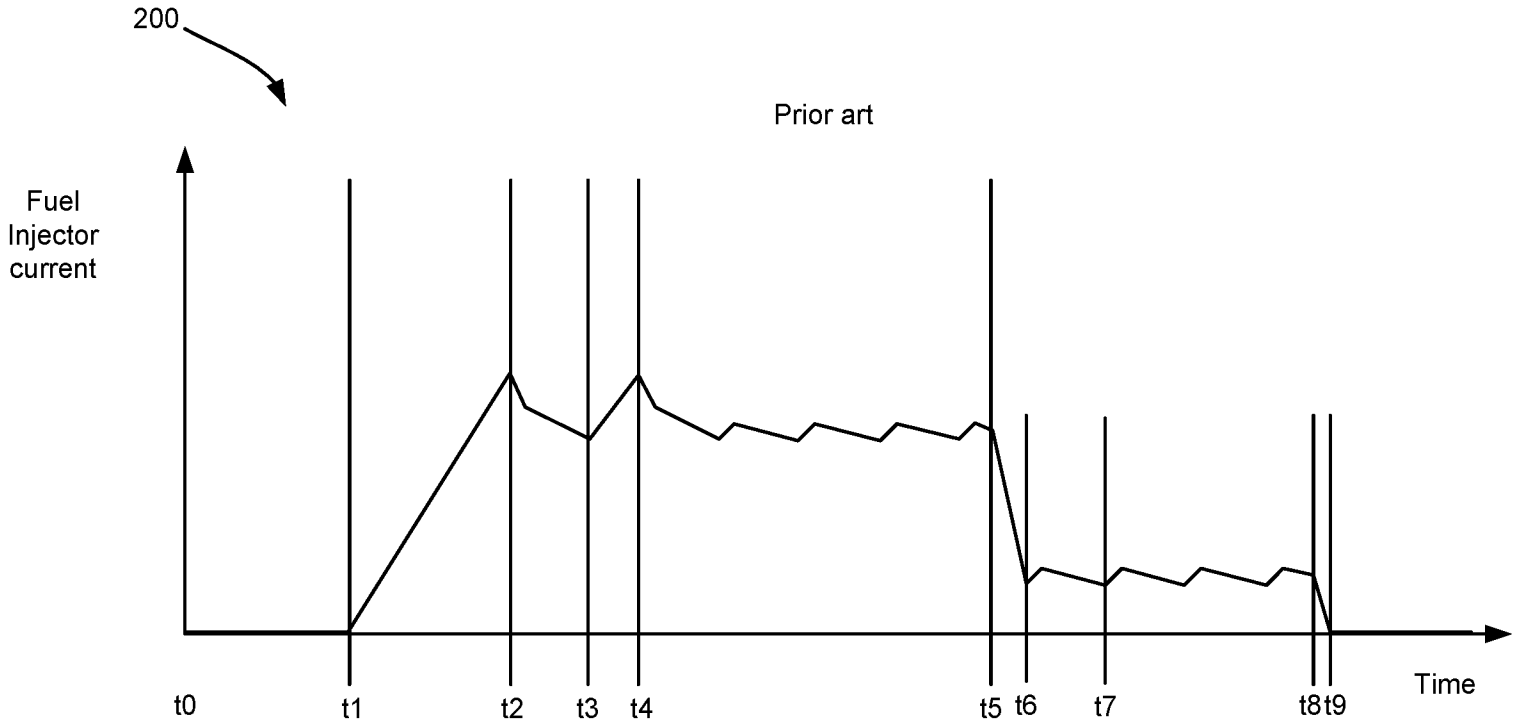
FIG. 2 shows electric current flowing through a fuel injector according to a prior art method.
Figure 3:
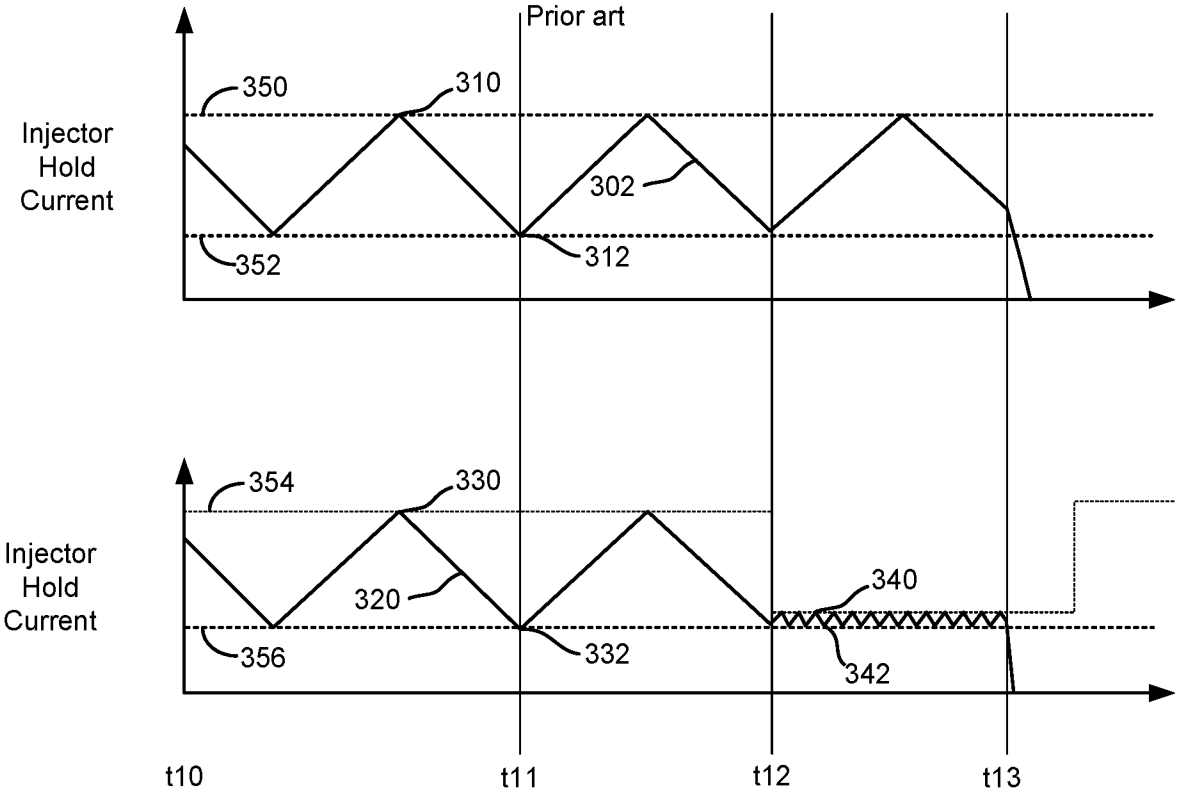
FIG. 3 shows prophetic examples of holding current flowing to fuel injectors according to a prior art method and holding current flowing to fuel injectors according to the method of the present invention.
Figure 4:
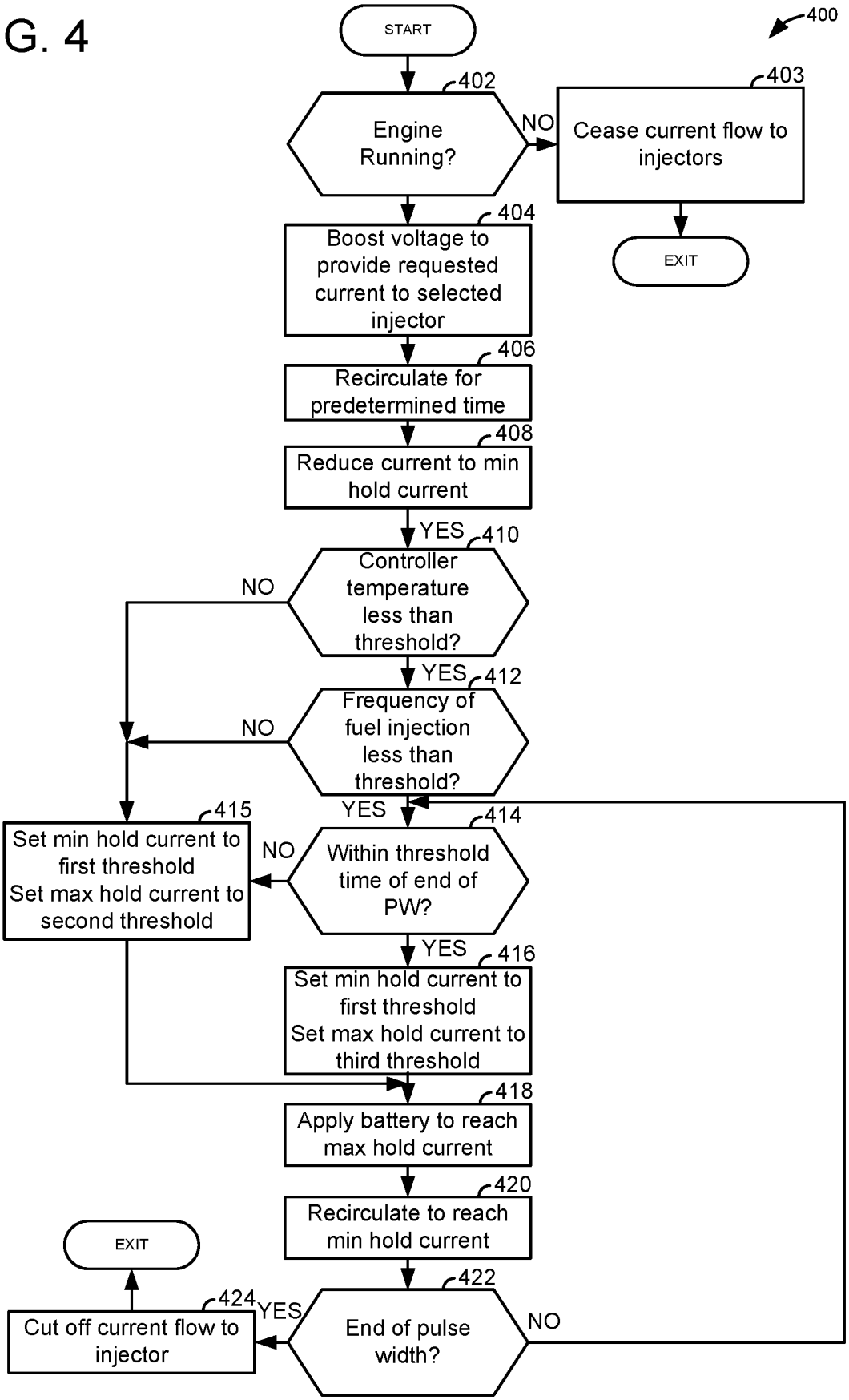
FIG. 4 shows a method for operating a fuel injector.
Figure 5:
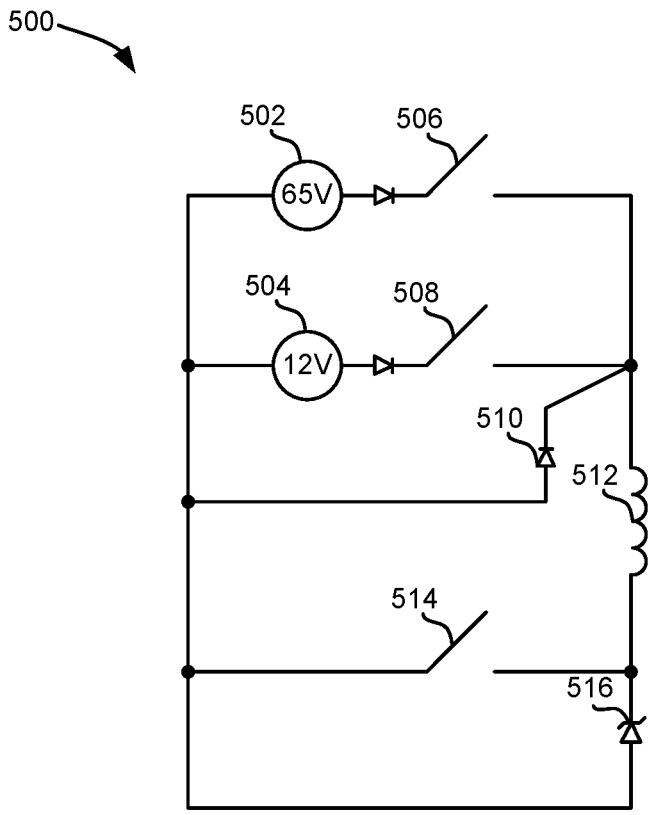
FIG. 5 shows an example circuit for operating a fuel injector.

The present description is related to reducing fuel injection variation. Fuel may be directly injected to engine cylinders via direct fuel injectors as shown in FIG. 1. A prior art electric current profile for a fuel injector is shown in FIG. 2. A plot of a close-up view of holding current for a prior art method for operating a fuel injector is shown in FIG. 3. A plot of a close-up view of holding current for operating a fuel injector according to the present method is also shown in FIG. 3. A method for operating a fuel injector is shown in FIG. 4. The method of FIG. 4 reduces a maximum holding current and increases a frequency of an electrical current adjustment so that consistency of closing timing of a fuel injector may be improved. A simplified circuit diagram for a direct fuel injector is shown in FIG. 5.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 30, which is known to those skilled in the art as direct injection. Port fuel injector 67, injects fuel to intake port 69, which is known to those skilled in the art as port injection. Fuel injector 66 delivers liquid fuel in proportion to a voltage pulse width or fuel injector pulse width of a signal from controller 12. Likewise, fuel injector 67 delivers liquid fuel in proportion to a voltage pulse width or fuel injector pulse width from controller 12. Fuel is delivered to fuel injectors 66 and 67 by a fuel system (not shown) including a fuel tank, fuel pump, and fuel rail (not shown). Fuel is supplied to direct fuel injector 66 at a higher pressure than fuel is supplied to port fuel injector 67. In addition, intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a propulsive effort pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. Further, in some examples, other engine configurations may be employed, for example a diesel engine with multiple fuel injectors. Further, controller 12 may receive input and communicate conditions such as degradation of components to light, or alternatively, human/machine interface 171.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Thus, the system of FIG. 1 provides for a system, comprising: a fuel injector; and a controller including executable instructions stored in non-transitory memory that cause the controller to adjust a maximum holding current from a first value to a second value, and adjust a holding current from the maximum holding current to a minimum holding current during a fuel injection period. The system includes where the fuel injection period is shorter than an engine cycle. The system includes where the first value is greater than the second value. The system includes where the maximum holding current is adjusted from the first value to the second value a predetermined amount of time before an end of fuel injection for the fuel injection period. The system includes where the predetermined amount of time is based on a period of the holding current. The system further comprises additional instructions to increase a frequency of adjusting the holding current from the maximum holding current to the minimum holding current and back to the maximum holding current when the maximum holding current is adjusted to the second value. The system further comprises not adjusting the maximum holding current in response to a temperature of the controller. The system further comprises not adjusting the maximum holding current in response to a frequency of fuel injection not being less than a threshold.

Referring now to FIG. 2, an electric current profile for a fuel injector is shown. The electric current profile shows electric current flow into a fuel injector while fuel is being injected via the fuel injector. The fuel injector may be a direct fuel injector 66 as shown in FIG. 1. The references to the low side switch, boost high side switch, and the battery high side switch mentioned in the description of FIG. 2 refer to the switches that are shown in FIG. 5.

Plot 200 shows a plot of fuel injector current amount versus time. The vertical axis represents an amount of electric current flowing into a fuel injector and the amount of electric current increases in the direction of the vertical axis arrow. The horizontal axis represents time and time increases from the left side of the plot to the right side of the plot.

At time t0, the amount of electric current flowing into the fuel injector is zero. The fuel injector is fully closed (not shown) and fuel is not flowing through the fuel injector.

At time t1, the fuel injector is commanded to open and a boosted voltage (e.g., 65 volts DC) is applied to the fuel injector (not shown) by closing the boost high side switch. Applying the boosted voltage causes electric current to begin to flow into the fuel injector. This may be referred to as a first boost phase or simply a boost phase during the fuel injection period. Time t1 is also the beginning of the fuel injection period, or the beginning of a time period in which fuel is injected via the fuel injector. The fuel injection period may be a function of a requested amount of fuel to inject to an engine cylinder via a fuel injector. During the boost phase, the battery high side switch and the low side switch are also closed to allow electric current to flow into the fuel injector (not shown).

At time t2, the amount of electric current flowing into the fuel injector reaches a threshold. Therefore, the boost phase is ended so as to allow the amount of electric current flowing into the fuel injector to be reduced. The boost phase is ended by opening the boost high side switch and leaving the battery high side switch closed (not shown). The low side switch also remains closed (not shown).

At time t3, the boosted voltage is applied to the fuel injector a second time, although this application of the boost voltage is optional. The boost high side switch is closed so that the electric current flowing into the fuel injector begins to increase. The battery high side switch and the low side switch remain closed.

At time t4, the amount of electric current flowing into the fuel injector reaches the threshold again. Therefore, the boost phase is ended so as to allow the amount of electric current flowing into the fuel injector to be reduced. The boost phase is ended by opening the boost high side switch and leaving the battery high side switch closed (not shown). The low side switch also remains closed (not shown). The pick-up or recirculation mode begins. In between time t4 and time t5, the battery high side switch may be repeatedly opened and closed. The battery high side switch may be opened if the fuel injector current is not less than a threshold and the battery high side switch may be closed if the fuel injector current is reduced to the threshold. The battery high side switch may remain closed until the fuel injector current exceeds a second threshold current. These actions cause the fuel injector to open without drawing large amounts of electric current.

At time t5, which may be a predetermined amount of time since time t1, the fuel injector is open and the low side switch is opened so that the amount of energy stored in the fuel injector's coil may be reduced via allowing current to flow through a freewheeling diode. The battery high side switch is closed and the boost high side switch is closed. As a result, the amount of electric current that is flowing into the fuel injector may be quickly reduced.

At time t6, the electric current flowing into the fuel injector is reduced to a minimum holding current. The holding phase begins and the freewheeling phase ends at time t6. The low side switch is closed and the battery high side switch is closed so that the amount of electric current flowing into the fuel injector begins to increase toward a maximum holding current. By operating the fuel injector with an electric current that is between the maximum holding current and the minimum holding current, the fuel injector may remain in an open state while consuming little electric energy. While the fuel injector is operated in the holding phase (e.g., between time t6 and commanding the fuel injector closed at time t8), the amount of electric current flowing through the fuel injector is cycled between a minimum holding current and a maximum holding current. The amount of holding current is cycled from the minimum holding current to the maximum holding current by closing the battery high side switch when the electric current flowing through the fuel injector is less than or equal to the minimum holding current and opening the battery high side switch when the electric current flowing through the fuel injector is equal to or greater than the maximum holding current. The minimum holding current and the maximum holding current are held at constant values during the holding phase. A period in which the fuel injector holding current is cycled from the minimum holding current to the maximum holding current is indicated as the amount of time between time t6 and time t7.

At time t8, the fuel injector is commanded to cease injecting fuel such that the fuel injector is off or closed. The fuel injector holding phase is ended when the fuel injector is commanded to cease injecting fuel off. The fuel injector is commanded to cease injecting fuel or off by opening the low side switch when the battery high side switch and the boost high side switch are open. Energy that is stored in the fuel injector is reduced to zero and current flow through the fuel injector is zero at time t9. Time t9 is also the end of the fuel injection period. The energy that is stored in the fuel injector is dissipated by allowing electric current to flow through a freewheeling diode (as shown in FIG. 5) between time t8 and time t9.

Referring now to FIG. 3, plots that illustrate holding current control for fuel injectors according to the prior art and according to the present method are shown. The plots show how holding current may be controlled during a holding phase of fuel injection once the fuel injector is in an open state. The plots of FIG. 3 are aligned in time.

The first plot from the top of FIG. 3 shows a plot of holding current according to the prior art. The vertical axis represents fuel injector holding current and holding current increases in the direction of the vertical axis arrow. The horizontal axis represents time and time increases from the left side of the figure to the right side of the figure. Line 302 represents holding current according to a prior art method. Dashed line 350 represents a maximum holding current threshold and dashed line 352 represents a minimum holding current threshold.

The second plot from the top of FIG. 3 shows a plot of holding current according to the present method described herein. The vertical axis represents fuel injector holding current and holding current increases in the direction of the vertical axis arrow. The horizontal axis represents time and time increases from the left side of the figure to the right side of the figure. Line 320 represents holding current according to a present method. Dashed line 354 represents a maximum holding current threshold and dashed line 356 represents a minimum holding current threshold.

At time t10, the holding current according to the prior art method is declining when the battery high side switch and the boost high side switch are open while the low side switch is closed (not shown) as indicated in the first plot from the top of FIG. 3. Likewise, the holding current according to the present method is declining when the battery high side switch and the boost high side switch are open while the low side switch is closed (not shown) as indicated in the second plot from the top of FIG. 3. Between time t10 and time t12, the holding currents decrease and increase. In particular, the holding currents increase until the holding currents reach the maximum holding current thresholds as indicated by line 350 and line 354. The holding currents decrease after the reaching the maximum holding currents until the holding currents reach the minimum holding current thresholds as indicated by line 352 and line 356. For example, the holding current decreases after reaching a maximum at 310 and it increases after reaching a minimum at 312. The amount of time between time t11 and time 12 is one period of the holding current oscillation for the prior art holding current control method and for the present method.

At time t12, the prior art holding current and the holding current according to the present method are within one period of the fuel injector being commanded off. The prior art holding current begins to increase after it has reached the minimum holding current threshold at time t12. The maximum holding current threshold 350 according to the prior art method is unchanged. The holding current according to the present method also begins to increase, but its maximum holding current threshold 354 has been reduced significantly.

Between time t12 and time t13, the holding current according to the prior art method oscillates between its maximum holding current threshold 350 and its minimum holding current threshold 352. The rate or frequency that the prior art method holding current oscillates between its maximum holding current threshold 350 and its minimum holding current threshold 352 is a function of the fuel injector's temperature, internal resistance, internal inductance, minimum holding current threshold 352, maximum holding current threshold 350, and battery voltage. The prior art holding current continues to oscillate at a same rate that it oscillated before time t12. The rate or frequency that the present method holding current oscillates between its maximum holding current threshold 354 and its minimum holding current threshold 356 is a function of the fuel injector's temperature, internal resistance, internal inductance, minimum holding current threshold 356, maximum holding current threshold 354, and battery voltage. Since the holding current maximum threshold for the present method 354 is reduced at time t12, the holding current according to the present method is increased in its frequency of oscillation. For example, the holding current decreases after reaching a maximum at 340 and it increases after reaching a minimum at 342. The amount of time between the peak at 340 and the valley at 342 is much smaller than the amount of time between peak 310 and valley 312. The higher frequency of oscillation may increase a temperature of transistor switches within the controller. Therefore, the maximum holding current threshold 354 may be reduced only when a temperature of the controller is less than a threshold temperature so that the controller may remain within temperature limits. The fuel injectors are commanded off at time t13.

The advantage of reducing the maximum holding current may be explained with the aid of FIG. 3 by comparing the fuel injector current levels according to the prior art method and the present method. In particular, a fuel injector according to the prior art method may be commanded off any time the holding current flowing into the fuel injector is between the minimum holding current 312 and the maximum holding current 310. The amount of time that it takes to fully close the fuel injector is a function of the amount of holding current that is flowing through the fuel injector when it is commanded off (e.g., when the boost high side switch, the battery high side switch, and the low side switch are commanded off or open). Therefore, the variation in the amount of fuel that is injected by the fuel injector may vary significantly more for the prior art method of holding current control as compared to the present method since the difference between the maximum holding current and the minimum holding current is much less according to the present method.

Referring now to FIG. 4, a method for operating a fuel injector is described. The method of FIG. 4 may be incorporated into the system of FIG. 1 as executable instructions stored in non-transitory memory. The method of FIG. 4 may cause the controller of FIG. 1 to receive inputs from one or more sensors described herein and adjust positions or operating states of one or more actuators described herein in the physical world. The switches, diodes, and fuel injectors mentioned in the description of FIG. 4 may be included in a circuit as described in FIG. 5.

At 402, method 400 judges whether or not the engine is running (e.g., rotating and combusting fuel). If so, the answer is yes and method 400 proceeds to 404. Otherwise, the answer is no and method 400 proceeds to 403. In one example, method 400 may judge that the engine is running if fuel is being injected to the engine and engine speed is greater than a threshold speed.

At 403, method 400 ceases current flow to the engine's fuel injectors. Method 400 proceeds to exit.

At 404, method 400 applies a boost voltage to a selected fuel injector that is to deliver fuel to an engine cylinder during a cycle of an engine. Thus, the injection period for the selected fuel injector begins. The injection period duration may be a function of a requested amount of fuel to be delivered via the selected fuel injector, and the requested amount of fuel may be a function of engine speed and a driver demand torque or power. In one example, the boost voltage is applied to the fuel injector via closing a boost high side switch while a low side switch and a battery high side switch are also closed. The boost voltage may be 65 volts and the battery voltage may be 12 volts. By applying the boost voltage to the selected fuel injector, the selected fuel injector may open at a faster rate as compare to if battery voltage were applied to the selected fuel injector. Method 400 proceeds to 406.

At 406, method 400 recirculates current in the fuel injector via opening the boost high side switch and flowing current through a freewheeling diode via opening the boost high side switch while the battery high side switch is closed and while the low side switch is closed. By recirculating current to the fuel injector, generation of large voltage spikes may be prevented. The current may be recirculated for a predetermined amount of time. Method 400 proceeds to 408.

At 408, method 400 reduces the electric current that is flowing through the selected fuel injector to the minimum hold current threshold value. In one example, method 400 may open the low side switch to reduce the amount of electric current that is flowing through the selected fuel injector to the minimum hold current. The boost high side switch may remain open and the battery high side switch may remain closed. The selected fuel injector enters a holding current phase and exits a boost phase. However, in some examples, method 400 may generate two boost phases before entering the holding current phase. Method 400 proceeds to 410.

At 410, method 400 judges if the temperature of the controller is less than a threshold temperature. If so, the answer is yes and method 400 proceeds to 412. Otherwise, the answer is no and method 400 proceeds to 415. In one example, the threshold controller temperature is a temperature that is not to be exceeded so that the possibility of controller degradation due to temperature may be reduced.

At 415, method 400 adjusts a minimum fuel injection holding current to a first threshold value. Method 400 also adjusts the maximum fuel injection holding current to a second threshold value, the second threshold value is greater than the first threshold value. Method 400 proceeds to 418.

At 412, method 400 judges if a frequency of fuel injection per unit time (e.g., 200 injections/second) is less than a threshold. Alternatively, method 400 may judge if engine speed is less than a threshold speed. If so, the answer is yes and method 400 proceeds to 414. Otherwise, the answer is no and method 400 proceeds to 415. Method 400 may judge if engine speed or an actual total number of fuel injections per unit time is greater than their respective threshold to determine if reducing the maximum holding current may cause the temperature of the controller to increase faster than may be desired.

At 414, method 400 judge whether or not the present time is within a threshold amount of time that the fuel injector is scheduled to be turned off. In one example, the threshold amount of time is based on a period of the holding current of the fuel injector just prior to reducing the maximum holding current to a third threshold, the third threshold being less than the second threshold. For example, the amount of time between time t11 and time t12 in FIG. 3 is equal to the period of the holding current for a fuel injection cycle before a maximum holding current of the fuel injector is reduced. Method 400 may judge that the present time is within a threshold amount of time of a scheduled fuel injector off time if the present time is within one period of the holding current frequency of change before the maximum holding current is reduced (e.g., 200 micro-seconds). In another example, method 400 may judge whether or not the present time is within a predetermined amount of time that the fuel injector is scheduled to be turned off. The predetermined amount of time may be based on the expected holding time of the fuel injector and the end of injection time of the fuel injector. The fuel injector off time may be based on engine position, engine speed, and commanded fuel pulse width. If method 400 judges that the present time is within a threshold amount of time of end of injection for the present fuel injection cycle (e.g., opening and closing of the fuel injector), then the answer is yes and method 400 proceeds to 416. Otherwise, the answer is no and method 400 proceeds to 415.

At 416, method 400 adjusts the minimum fuel injector holding current threshold to the first threshold level or value. Method 400 also adjusts the maximum fuel injector holding current threshold to the third threshold level or value, the third threshold value or level being less than the second threshold level or value. Thus, if the present time is within a threshold time of a schedule end of injection time for the selected fuel injector the maximum holding current value may be reduced so that the variation in injector closing timing may be reduced. In addition, the frequency of changing of the holding current may be increased since the rate of holding current increase and holding current decrease are a function of fuel injector operating conditions. In addition, since the maximum fuel injector holding current is closer to the minimum fuel injector holding current, the amount of time t0 switch the holding current from the maximum threshold to the minimum threshold and vice-versa is decreased. Method 400 proceeds to 418.

At 418, method 400 applies battery voltage to the selected fuel injector so as to increase holding current toward the maximum holding current. The battery voltage may be applied to the selected fuel injector by closing the battery high side switch. Method 400 proceeds to 420.

At 420, method 400 begins to recirculate electric current in the selected fuel injector when the selected fuel injector current reaches the fuel injector maximum holding current. Method 400 may begin recirculating current via opening the low side switch. By opening the low side switch, current may flow through the freewheeling diode. Method 400 continues to be in a recirculating mode until the electric current in the fuel injector is reduced to the minimum fuel injector holding current. Method 400 proceeds to 422.

At 422, method 400 judges if the selected fuel injector has been commanded closed (e.g., the fuel injector is at the end of the fuel injection pulse width). If so, the answer is yes and method 400 proceeds to 424. Otherwise, the answer is no and method 400 returns to 414.

At 424, method 400 ceases flowing electric current to the selected fuel injector. In one example, method 400 may open the battery high side switch, the low side switch, and the boost high side switch to cease electric current flow to the selected fuel injector. The fuel injection period ends when the fuel injector is closed. In some examples, a fuel injector may inject fuel a plurality of times to a cylinder during a cycle of an engine. Thus, there may be more than one fuel injection period for a fuel injector during a cycle of an engine and a fuel injection period may be shorter in duration than an engine cycle. Additionally, the maximum fuel injector holding current may be adjusted back to the second threshold level. Method 400 proceeds to exit.

In this way, an amount of holding current flowing through a selected fuel injector may be adjusted. The adjustments to the selected fuel injector's holding current may reduce variation in fuel injector closing time, which may reduce variation in an amount of fuel that is injected by the selected fuel injector. The method of FIG. 4 may be applied to each of the engine's fuel injectors.

The method of FIG. 4 provides for a method for operating a fuel injector, comprising: adjusting a maximum holding current value from a first value to a second value via a controller during a first fuel injection period of the fuel injector. The method further comprises adjusting the maximum holding current value from the second value to the first value before a second subsequent fuel injection period. The method further comprises adjusting a frequency of a holding current responsive to engine speed being less than a threshold speed. The method includes where the maximum holding current value is adjusted in response to a temperature of a controller being less than a threshold. The method includes where the maximum holding current is adjusted from the first value to the second value a predetermined amount of time before an end of the first fuel injection period.

The method of FIG. 4 also provides for a method for operating a fuel injector, comprising: adjusting a holding current of a fuel injector at a first frequency via a controller during a fuel injection period of the fuel injector; and adjusting the holding current of the fuel injector at a second frequency via the controller during the fuel injection period of the fuel injector. The method includes where the fuel injection period is less than an cycle of an engine. The method includes where the first frequency is lower than the second frequency. The method includes where the holding current of the fuel injector is adjusted at the second frequency beginning a predetermined amount of time before a scheduled end of fuel injection for the fuel injector. The method include where the predetermined amount of time is based on a period of the first frequency. The method further comprises adjusting the holding current of the fuel injector to the second frequency in response to a frequency of fuel injection being less than a threshold. The method further comprises not adjusting the holding current of the fuel injector to the second frequency in response to the frequency of fuel injection being greater than the threshold.

Referring now to FIG. 5, an example electrical circuit 500 for operating a fuel injector is shown. A similar electrical circuit 500 may be provided for each fuel injector and the electrical circuit of FIG. 5 may be included in the system of FIG. 1, in controller 12 for example.

Circuit 500 includes a boosted power supply 502 that outputs a first voltage (e.g., 65 volts—a boosted voltage) and a battery 504 that outputs battery voltage (e.g., 12 volts). The boosted voltage may be selectively electrically coupled to fuel injector coil 512 to activate the fuel injector and begin fuel delivery from the fuel injector to an engine. The boosted voltage may be applied to the fuel injector coil 512 via boost high side switch 506. Boost high side switch 506 may be a transistor such as a field effect transistor, bipolar transistor, or other known transistor. Boost high side switch 506 may be closed to apply the boosted voltage to the fuel injector coil 512.

The battery voltage may also be selectively electrically coupled to fuel injector coil 512 to hold open the fuel injector and continue fuel delivery from the fuel injector to an engine. The battery voltage may be applied to the fuel injector coil 512 via battery high side switch 508. Battery high side switch 508 may be a transistor such as a field effect transistor, bipolar transistor, or other known transistor. Battery high side switch 508 may be closed to apply the battery voltage to the fuel injector coil 512. Switches 506 and 508 may referred to high side switches since they are located closer to the higher potential sides of battery 504 and boosted power supply 502.

Circuit 500 also includes a freewheel diode 510 that allows electrical current to flow through the freewheel diode and to fuel injector coil when current flow from the boosted high side switch or from the battery high side switch to the fuel injector coil 516 is interrupted. Circuit 500 also includes a Zener diode 516 that includes a threshold breakdown voltage (e.g., 65 volts). Finally, circuit 500 includes a low side switch 514 that may be closed to activate the fuel injector and opened to deactivate the fuel injector.

Thus, the system of FIGS. 1 and 5 provides for a system, comprising: a fuel injector; and a controller including executable instructions stored in non-transitory memory that cause the controller to adjust a maximum holding current from a first value to a second value, and adjust a holding current from the maximum holding current to a minimum holding current during a fuel injection period. The system includes where the fuel injection period is shorter than an engine cycle. The system includes where the first value is greater than the second value. The system includes where the maximum holding current is adjusted from the first value to the second value a predetermined amount of time before an end of fuel injection for the fuel injection period. The system includes where the predetermined amount of time is based on a period of the holding current. The system further comprises additional instructions to increase a frequency of adjusting the holding current from the maximum holding current to the minimum holding current and back to the maximum holding current when the maximum holding current is adjusted to the second value. The system further comprises not adjusting the maximum holding current in response to a temperature of the controller. The system further comprises not adjusting the maximum holding current in response to a frequency of fuel injection not being less than a threshold.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A system, comprising:

a fuel injector; and a controller including executable instructions stored in non-transitory memory that cause the controller to adjust a maximum fuel injector holding current from a first value to a second value, and adjust a fuel injector holding current from the maximum fuel injector holding current to a minimum fuel injector holding current during a fuel injection period, and executable instructions to adjust a holding current frequency of a fuel injector responsive to engine speed being less than a threshold speed.

2. The system of claim 1, where the fuel injection period is shorter than an engine cycle.

3. The system of claim 1, where the first value is greater than the second value.

4. The system of claim 1, where the maximum fuel injector holding current is adjusted from the first value to the second value a predetermined amount of time before an end of fuel injection for the fuel injection period.

5. The system of claim 4, where the predetermined amount of time is based on a period of the fuel injector holding current.

6. The system of claim 1, further comprising additional instructions to increase a frequency of adjusting the fuel injector holding current from the maximum fuel injector holding current to the minimum fuel injector holding current and back to the maximum fuel injector holding current when the maximum fuel injector holding current is adjusted to the second value.

7. The system of claim 6, further comprising not adjusting the maximum fuel injector holding current in response to a temperature of the controller.

8. The system of claim 6, further comprising not adjusting the maximum fuel injector holding current in response to a frequency of fuel injection not being less than a threshold.

9. A method for operating a fuel injector, comprising:

adjusting a maximum fuel injector holding current value from a first value to a second value via a controller during a first fuel injection period of the fuel injector, where the maximum fuel injector holding current value is adjusted in response to a temperature of a controller being less than a threshold.

10. The method of claim 9, further comprising adjusting the maximum fuel injector holding current value from the second value to the first value before a second subsequent fuel injection period.

11. The method of claim 10, further comprising adjusting a frequency of a fuel injector holding current responsive to engine speed being less than a threshold speed.

12. The method of claim 9, where the maximum fuel injector holding current is adjusted from the first value to the second value a predetermined amount of time before an end of the first fuel injection period.

13. A method for operating a fuel injector, comprising:

adjusting a fuel injector holding current of a fuel injector at a first frequency via a controller during a fuel injection period of the fuel injector; and adjusting the fuel injector holding current of the fuel injector at a second frequency via the controller during the fuel injection period of the fuel injector, where the fuel injector holding current of the fuel injector is adjusted at the second frequency beginning a predetermined amount of time before a scheduled end of fuel injection for the fuel injector, and where the predetermined amount of time is based on a period of the first frequency.

14. The method of claim 13, where the fuel injection period is less than a cycle of an engine.

15. The method of claim 13, where the first frequency is lower than the second frequency.

16. The method of claim 13, further comprising adjusting the fuel injector holding current of the fuel injector to the second frequency in response to a frequency of fuel injection being less than a threshold.

17. The method of claim 16, further comprising not adjusting the fuel injector holding current of the fuel injector to the second frequency in response to the frequency of fuel injection being greater than the threshold.

* * * * *